United States Patent [19]

Bell et al.

[11] 4,385,563

[45] May 31, 1983

[54] ROOF SUPPORT FOR A RAILROAD CAR ROOF

[75] Inventors: Edward A. Bell, Lansing; William E. Solt, Olympia Fields, both of Ill.

[73] Assignee: Abex Corporation, New York, N.Y.

[21] Appl. No.: 252,650

[22] Filed: Apr. 9, 1981

[51] Int. Cl.[3] ..... B61D 17/16

[52] U.S. Cl. ..... 105/377; 52/45; 52/53

[58] Field of Search ..... 105/377; 52/45, 48, 52/54, 51, 53, 55, 56, 46, 47, 49, 50, 52, 19, 72, 200

[56] References Cited

U.S. PATENT DOCUMENTS

| | | | |
|---|---|---|---|
| 950,487 | 3/1910 | Masker | 52/54 |
| 3,145,665 | 8/1964 | Hamilton | 105/377 |
| 3,678,867 | 7/1972 | Brinks et al. | 105/377 |

*Primary Examiner*—Bruce H. Stoner, Jr.
*Assistant Examiner*—Richard Mathieu
*Attorney, Agent, or Firm*—Thomas S. Baker, Jr.; David A. Greenlee

[57] ABSTRACT

A roof support for a partitioned, covered hopper railway car having a longitudinal roof hatch which supports the roof between the end partition and an end wall without interfering with the hatch opening and transfers a portion of the roof load to the side walls of the car.

2 Claims, 6 Drawing Figures

ROOF SUPPORT FOR A RAILROAD CAR ROOF

BACKGROUND OF THE INVENTION

The instant invention relates to a partitioned, covered railroad hopper car having a longitudinal roof hatch which extends substantially the entire length of the car. In particular, the invention relates to a roof support which supports the portion of the car roof between the end partition and the end of the car and transfers that portion of the roof load to the sides of the car.

A covered railroad hopper car with a longitudinal roof hatch is commonly used to haul grain or bulk chemicals. Such a car is normally divided into a plurality of compartments which are defined by transverse walls or partitions. In some cars, the hatch roof is supported by partitions and by transverse members called carlines which are located between the partitions and extend between longitudinal members which extend along the tops of the car side walls. In addition to supporting the roof, the carlines prevent the side walls of the car from spreading and coming together.

A problem with carlines in a covered hopper car with a roof hatch is that during loading of the car, material builds up on the carlines and interferes with the loading process. Additionally, carlines are heavy and raise the center of gravity of the car. For these reasons, car builders have begun to eliminate carlines from beneath the hatches of covered hopper cars.

In cars where carlines have been removed, the partitions support the roof in the central portion of the car. In some cars, the roof load between the end partitions and the ends of the car are carried to the end walls of the car. However, it has been found that if the roof load between the end partition and the end of the car is carried to the sides of the car instead of the end wall of the car, the lateral rigidity of the car sides is increased. This increased rigidity reduces the frequency of roof fluctuations and thereby reduces the chances of fatigue failure.

It is desirable to provide a roof support for the hatch roof of a covered hopper car which transfers the roof load between the end partition and the end of the car to the sides of the car.

It is further desirable to provide a roof support for the hatch roof of a covered hopper railroad car which supports the roof load between the end partition and the end of the car adjacent the end of the hatch opening, such that the support does not project into the hatch opening.

SUMMARY OF THE INVENTION

The instant invention provides a roof support for the hatch roof of a covered hopper railroad car which transfers the portion of the roof load between the end partition and the end of the car to the sides of the car to thereby increase the lateral rigidity of the car sides and which does not interfere with the hatch opening.

DESCRIPTION OF THE PREFERRED EMBODIMENTS

Figure 1:
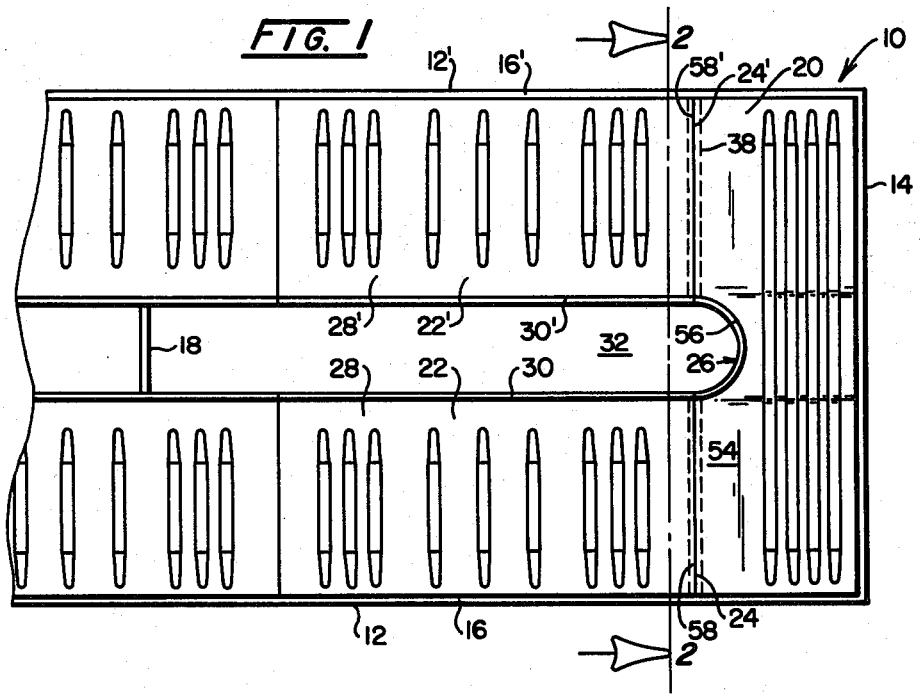
FIG. 1 is a plan view of one half of a covered hopper railroad car which has a hatch roof.

Referring to FIG. 1, a railroad hopper car 10 has a pair of longitudinally extending, vertical side walls 12, 12' and a pair of transversely extending, vertical end walls 14, of which one is shown. Since the elements on each side of the longitudinal centerline of the car are the same, elements on the top side of the centerline will be identified by identical primed numbers as those which identify elements on the bottom side of the centerline. The top edge of each side wall 12, 12' is defined by a flat, longitudinal member 16, 16' which extends between each of the end walls 14. A plurality of partitions 18 extend laterally between side walls 12, 12' to divide the car 10 into a plurality of individual compartments.

A roof 20 encloses the top of hopper car 10. The main portion of roof 20 includes a pair of identical longitudinally extending roof sheets 22, 22' which are supported at each end 24, 24' by a roof support 26. Each of the roof sheets 22, 22' has a generally horizontal flat surface 28, 28' which extends from the center of the car outwardly to the longitudinal member 16, 16' on the top surface of the side wall 12, 12'. The roof sheets 22, 22' are welded to the longitudinal members 16, 16' to secure the position of the roof sheets 22, 22'. The longitudinal edge of each roof sheet 22, 22' adjacent the center of the car 10 is formed into a vertically extending coaming 30, 30'. The space between the coamings 30, 30' of the two roof sheets 22, 22' defines a hatch opening 32 which extends substantially the entire length of car 10.

The roof sheets 22, 22' are supported at their outside longitudinal edge by the longitudinal members 16, 16' on top of side walls 12, 12' as described above and are supported laterally throughout their length by the partitions 18. There are no carlines which extend laterally between the longitudinal members 16, 16' to interfere with the hatch opening 32.

As previously mentioned, the ends 24, 24' of the roof sheets 22, 22' are supported by a roof support 26. The purpose of roof support 26 is to transfer the portion of the load from roof sheets 22, 22' between the partition 18 nearest the end of the car and the end wall 14 to the longitudinal members 16, 16' on top of the side walls 12, 12'.

Figure 2:
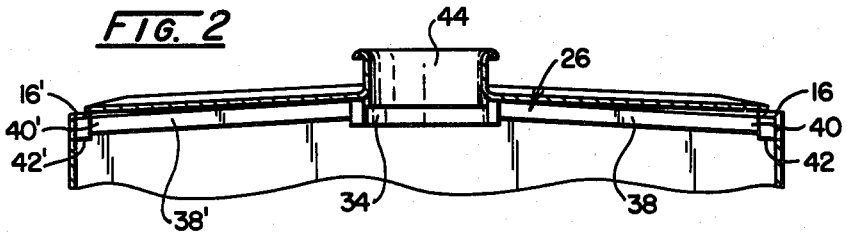
FIG. 2 is a sectional view along line 2—2 of FIG. 1 showing the roof support of the instant invention.
Figure 3:
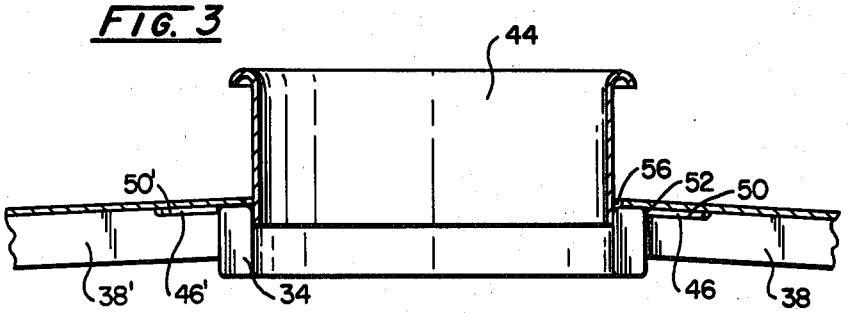
FIG. 3 is an enlarged front view of the central portion of the roof support shown in FIG. 2.
Figure 4:
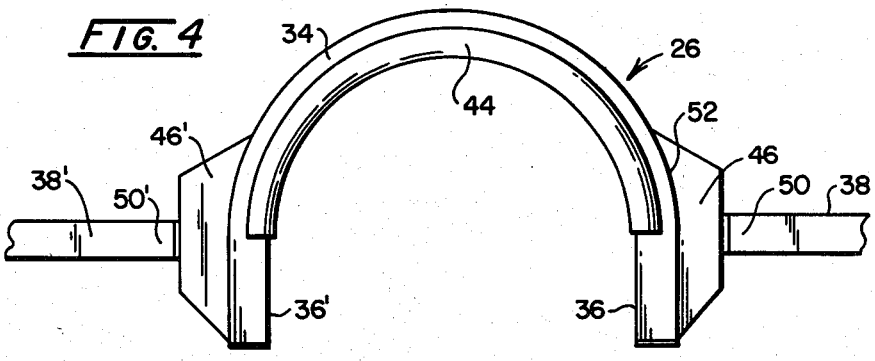
FIG. 4 is an enlarged top view of the roof support shown in FIG. 2 with the roof sheets removed.

Referring to FIGS. 2–4, each roof support 26 includes a central, semi-circular shaped yoke 34 which is formed from tubing having a rectangular cross-section. Each end of yoke 34 terminates in a short, straight section 36, 36'. A pair of tubes 38, 38' having a rectangular cross-section project radially and downardly from the yoke 34. The end 40, 40' of each carline tube 38, 38' remote from yoke 34 is welded into a U-shaped support bracket 42, 42' on side wall 12, 12' just below longitudinal member 16, 16' to thereby tie the roof support 26 into the side walls 12, 12'. Roof support 26 has a coaming 44 which projects vertically upward from yoke 34. Coaming 44 blends with and is welded to the roof sheet coamings 30, 30' when the roof sheets 22, 22' are mounted on support 26. Therefore, coaming 44 defines a semi-circular lateral edge of hatch opening 32 while the sheet coamings 30, 30' define the longitudinal edges of hatch opening 32. A gusset 46, 46' is welded to the top surface 50, 50' of each radial tube 38, 38' and the top outside surface 52 of yoke 34 to reinforce the attachment of the tubes 38, 38' to the yoke 34.

Referring to FIG. 1, it can be seen that the ends 24, 24' of the roof sheets 22, 22' rest on and are welded to the top surfaces 50, 50' of the radial tubes 38, 38', respectively.

The roof 20 includes an end sheet 54 positioned between roof support 26 and end wall 14 of the car. End sheet 54 has a cutout portion 56 which receives roof support yoke 34 and a pair of lateral edges 58, 58' which rest on and are welded to the top surfaces 50, 50' of the carline tubes 38, 38'. Consequently, the roof support 26 also transfers a portion of the load of end sheet 54 to the side walls 12, 12'.

Figure 5:
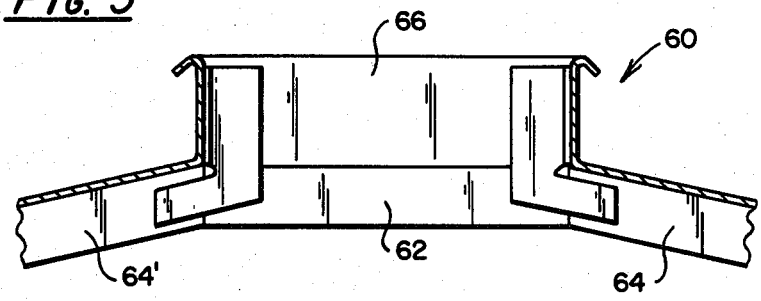
FIG. 5 is a sectional view similar to that of FIG. 3 showing an alternate embodiment of a roof support.
Figure 6:
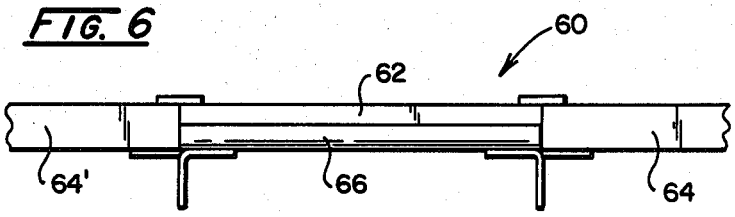
FIG. 6 is an enlarged top view of the alternate roof support shown in FIG. 5.

Referring to FIGS. 5 and 6, a second embodiment of a roof support 60 is shown. The main difference between the first embodiment and the second is that the former is used to define the lateral edges of a hatch opening 32 having semi-circular ends, whereas the latter is used to define the lateral edges of a rectangular hatch opening 32. The function of the two roof supports 26, 60 is identical. Both transfer a portion of the roof load between the end partition 18 and the end wall 14 of the car 10 to the side walls 12, 12'.

Roof support 60 includes a central, straight, horizontal, tubular section 62 having a rectangular cross-section and a pair of straight, downward sloping tubes 64, 64' which have a rectangular cross-section and project from each end of the central section 62. The ends, not shown, of the tubes 64, 64' remote from central section 62 are supported in and welded to U-shaped support brackets in the same way as the tubes 38, 38' of roof support 26. Roof support 60 has a coaming 66 which projects vertically upward from central section 62 to define the lateral edge of a rectangular hatch opening.

Although preferred embodiments of the invention have been illustrated and described, it will be apparent to those skilled in the art that various modifications may be made without departing from the spirit and scope of the present invention.

What is claimed is:

1. A railroad car including: a cargo space defined by a pair of longitudinally extending side walls and a pair of laterally extending end walls; a plurality of roof sheets covering the cargo space; a vertically extending coaming formed in the roof sheets which defines the longitudinal edges of a hatch opening, said hatch opening extending longitudinally of the roof, and at least one partition which extends laterally between the side walls and vertically to engage and support a portion of the roof load; characterized by a roof support having a central section and a pair of arms which project from opposite sides of the central section wherein the longitudinal axis of the arms passes through the hatch opening and said central section defines a portion of the hatch opening but does not intrude therein; means connecting one end of each of the arms to a side wall of the car to thereby connect the central section with each of the car side walls and a vertically extending coaming which is attached to the central section, projects upwardly from the central section and defines the lateral edge of the hatch opening and the roof support engages the roof and transfers a portion of the roof load between the partition nearest the end wall and the end wall to the side walls of the car without intruding into the hatch opening.

2. A railroad car as set forth in claim 1, wherein the central section of the roof support is a semi-circular shaped yoke and the coaming which projects upwardly to define the lateral edge of the hatch opening is attached to the yoke.

* * * * *